US006467394B1

(12) United States Patent
Wood et al.

(10) Patent No.: US 6,467,394 B1
(45) Date of Patent: Oct. 22, 2002

(54) OILLESS HIGH PRESSURE PUMP

(75) Inventors: Mark Wood, Jackson; Shane Dexter, Humboldt; Allen Palmer, Lexington, all of TN (US)

(73) Assignee: DeVilbiss Air Power Company, Jackson, TN (US)

( * ) Notice: Subject to any disclaimer, the term of this patent is extended or adjusted under 35 U.S.C. 154(b) by 66 days.

(21) Appl. No.: 09/639,573

(22) Filed: Aug. 14, 2000

(51) Int. Cl.[7] ..... F01B 7/00

(52) U.S. Cl. ..... 92/150; 92/137

(58) Field of Search ..... 92/150, 137, 84

(56) References Cited

U.S. PATENT DOCUMENTS 4,339,988 A * 7/1982 Steele ..... 91/493
5,769,321 A * 6/1998 Cyphers ..... 239/154

* cited by examiner

*Primary Examiner*—Kevin Lee
(74) *Attorney, Agent, or Firm*—Sulter & Associates PC

(57) ABSTRACT

An oilless high pressure pump suitable for use in devices such as pressure washers and the like is described. The pump includes an eccentric assembly suitable for converting rotary motion of a rotating shaft to rectilinear motion. One or more straps couple the eccentric assembly to the pump's piston assembly. The straps communicate the rectilinear motion of the eccentric assembly to the piston assembly for reciprocating the pump's pistons to pump the liquid.

24 Claims, 7 Drawing Sheets

OILLESS HIGH PRESSURE PUMP

CROSS REFERENCE TO RELATED APPLICATIONS

The present application is related to co-pending U.S. Pat. application Ser. No. 09/639,572, filed Aug. 14, 2000. Said U.S. Pat. application Ser. No. 09/639,572 is herein incorporated by reference in its entirety.

The present application is further related to co-pending U.S. Pat. application Ser. No. 09/639,435, filed Aug. 14, 2000. Said U.S. Pat. application Ser. No. 09/639,435 is herein incorporated by reference in its entirety.

FIELD OF THE INVENTION

The present invention generally relates to the field of devices such as pressure washers and the like that are capable of delivering a fluid from a supply source and discharging it at a greater pressure, and more particularly to an oilless high pressure pump suitable for use in such devices.

BACKGROUND OF THE INVENTION

High pressure washing devices, commonly referred to as pressure washers, deliver a fluid, typically water, under high pressure to a surface to be cleaned, stripped or prepared for other treatment. Pressure washers are produced in a variety of designs and can be used to perform numerous functions in industrial, commercial and home applications. Pressure washers typically include an internal combustion engine or electric motor that drives a pump to which a high pressure spray wand is coupled via a length of hose. Pressure washers may be stationary or portable. Stationary pressure washers are generally used in industrial or commercial applications such as car washes or the like. Portable pressure washers typically include a power/pump unit that can be carried or wheeled from place to place. A source of water, for example, a garden hose, is connected to the pump inlet, and the high pressure hose and spray wand connected to the pump outlet.

Typically, pressure washers utilize a piston pump having one or more reciprocating pistons for delivering liquid under pressure to the high pressure spay wand. Such piston pumps often utilize two or more pistons to provide a generally more continuous spray, higher flow rate, and greater efficiency. Multiple piston pumps typically employ articulated pistons (utilizing a journal bearing and wrist pins) or may utilize a swash plate and linear pistons for pumping the liquid. Because these piston arrangements generate a substantial amount of friction (such as for example, sliding friction between the swash plate and pistons), existing pumps utilized in pressure washers must typically be oil flooded to provide adequate lubrication. However, such oil lubricated pumps have several drawbacks. For example, the lubricating oil must be maintained at an adequate level and typically must be periodically replaced. Neglect of such maintenance can result in damage to the pump. Further, the orientation in which the pump may be mounted to the pressure washer frame is severely limited.

SUMMARY OF THE INVENTION

Accordingly, the present invention is directed to an oilless high pressure pump suitable for use in devices such as pressure washers and the like to pump a liquid such as water or the like. In an exemplary embodiment, the pump includes an eccentric assembly suitable for converting rotary motion of a rotating shaft to rectilinear motion. One or more straps couple the eccentric assembly to the pump's piston assembly. The straps communicate the rectilinear motion of the eccentric assembly to the piston assembly for reciprocating the pump's pistons to pump the liquid.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
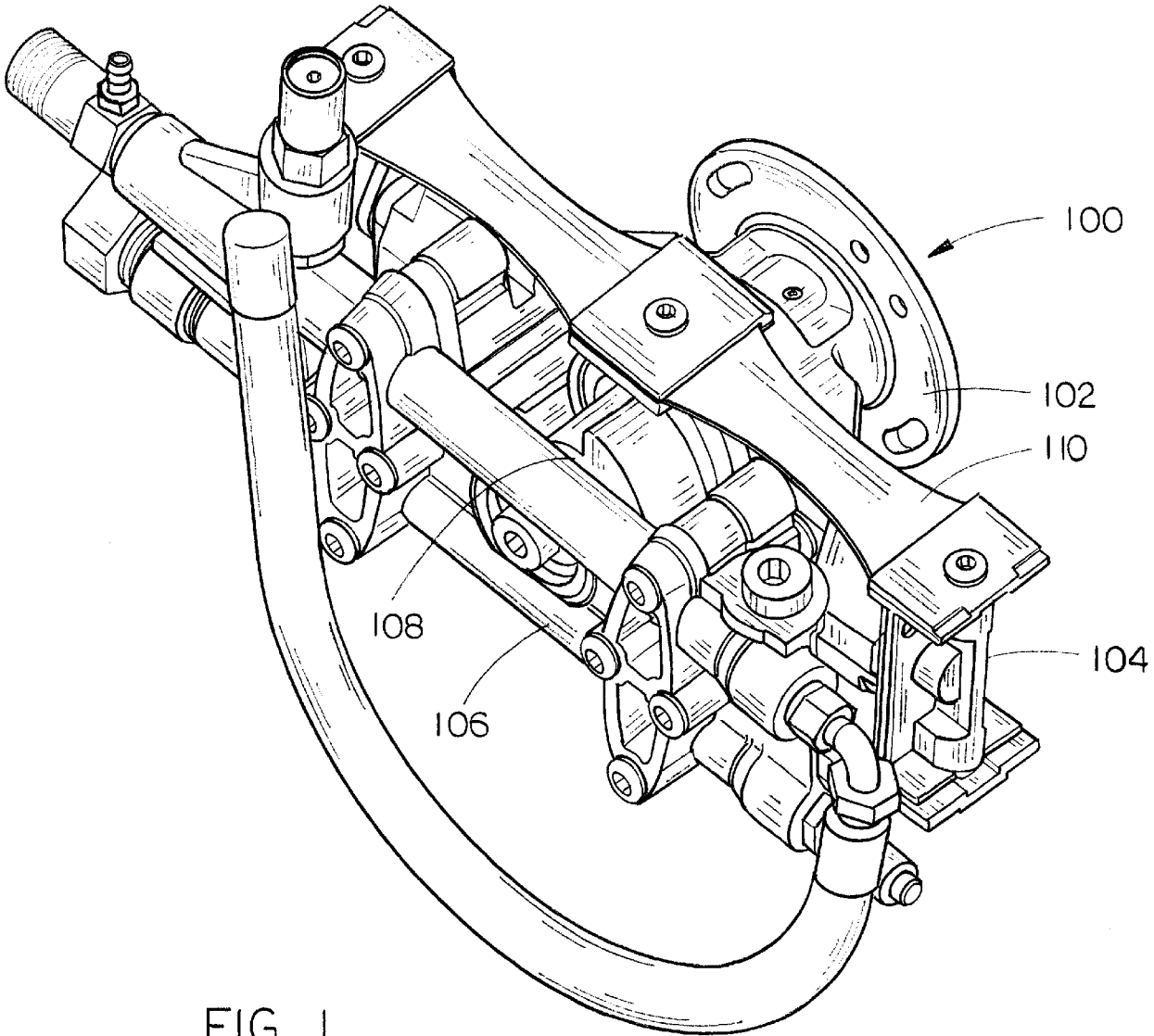
FIG. 1 is an isometric view of an oilless high pressure pump in accordance with an exemplary embodiment of the present invention.

Reference will now be made in detail to the presently preferred embodiments of the invention, examples of which are illustrated in the accompanying drawings.

Referring generally to FIGS. 1 through 4B, an oilless high pressure pump in accordance with an exemplary embodiment of the present invention is described. The pump 100 is comprised of a pump housing 102 supporting one or more piston assemblies 104 suitable for pumping a liquid such as water, or the like and a manifold or head assembly 106, coupled to the pump housing 102, for porting the liquid to and from the piston assemblies 104. In accordance with the present invention, an eccentric assembly 108 converts rotary motion of the rotating shaft of an engine (not shown) to rectilinear motion for reciprocating the piston assemblies 104. Flexible straps 110 couple the eccentric assembly 108 to the piston assemblies 104 to communicate the rectilinear motion of the eccentric assembly 108 to the piston assemblies 104 to pump the liquid. In exemplary embodiments, the eccentric assembly 108 employs sealed, deep grooved permanently lubricated bearing assemblies 112 & 114 allowing the pump 100.

The flexible straps 110 and sealed bearing assemblies 112 & 114 of the oilless high pressure pump 100 of the present invention do not utilize an oil sump for lubrication. Consequently, the pump 100 requires less maintenance than oil flooded high pressure pumps since the need to periodically change lubricating oil is eliminated. Further, because the pump 100 does not require a lubricating oil sump, it may be mounted in virtually any orientation. The present pump 100 may also provide increased mechanical efficiency compared to pumps employing articulated piston or swash plate/linear piston configurations since flexible straps 110 eliminate losses in mechanical efficiency caused by sliding friction and shearing of lubricating oil in the sump common to such pumps. Typically, articulated piston or swash plate/linear piston pumps operate at less than approximately 75 percent efficiency, while a pump manufactured in accordance with the present invention may operate at efficiencies greater than approximately 85 percent. This increased efficiency allows the pump 100 to produce higher pressures using the same power input from the engine. For instance, an exemplary pump 100 manufactured in accordance with the present invention, a rated pressure of 2200 PSI (pounds per square inch) and flow rate of 2.1 GPM (gallons per minute) would provide approximately 200 PSI of additional pressure compared to a corresponding articulated piston or swash plate/linear piston pump using the same power input, or alternately would require approximately 0.5 horsepower less power input to produce the same pressure and flow rate.

The axi-linear configuration of pump 100 further allows for the use of less costly materials and manufacturing methods than would be possible with other configurations. For instance, because of their complexity, the housings of typical articulated piston or swash plate/linear piston configuration pumps must often be forged. Further, such housing may require the use of materials such as brass due to high stresses encountered during operation of the pumps. However, the axi-linear design of pump 100 allows porting within the pump housing 102 and head assembly 106 to be greatly simplified and substantially reduces the magnitude of stresses incurred during operation. Thus, in exemplary embodiments, the pump body 122 and head assemblies 106 may be formed of die-cast aluminum resulting in substantial cost savings during manufacturing.

Figure 2:
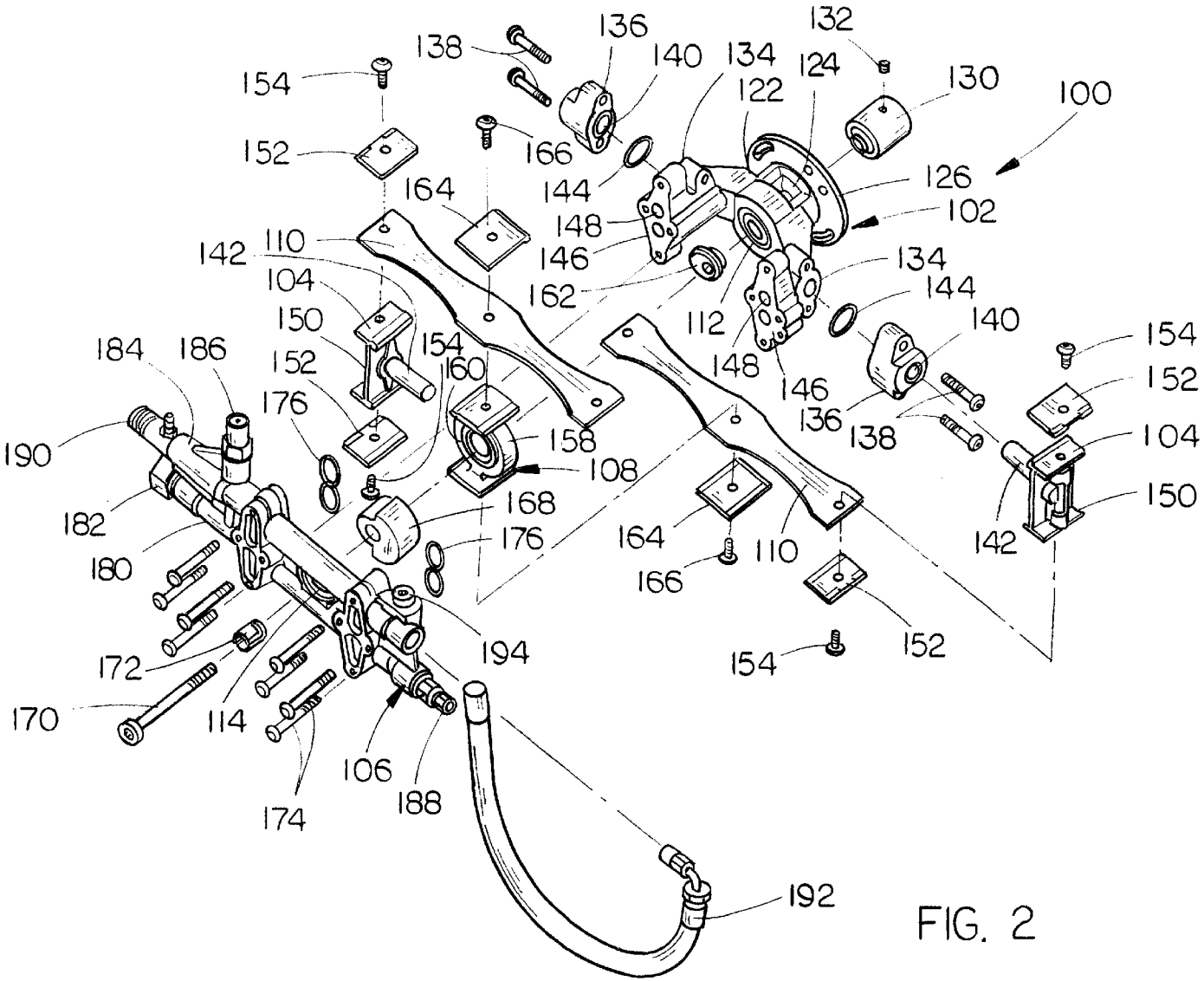
FIG. 2 is an exploded isometric view of the pump shown in FIG. 1 further illustrating the component parts of the pump.
Figure 3:
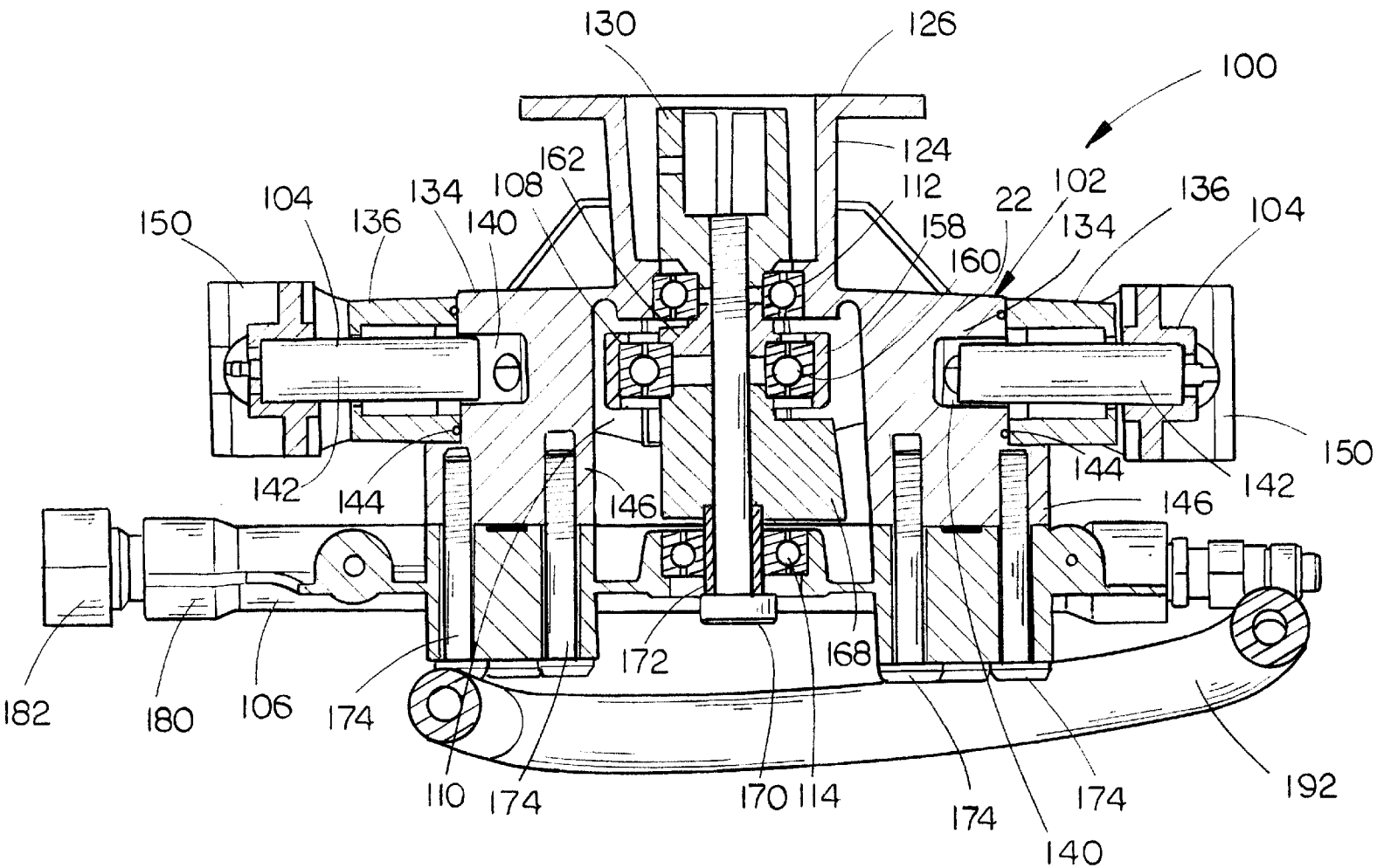
FIG. 3 is a cross-sectional view of the pump shown in FIG. 1, further illustrating the pump's eccentric and sealed bearing assemblies.

Referring now to FIGS. 2 and 3, pump housing 102 includes a pump body 122 having an shaft mounting portion 124 including a flange 126 suitable for coupling the pump 100 to an engine such as the internal combustion engine or electric motor of a pressure washer. Preferably, bearing assembly 112 is mounted in the shaft mounting portion 124 for supporting shaft 130 which is coupled to the drive shaft of an engine (not shown) via key 132. Pump body 122 may further include axi-linearly opposed cylinder head bosses 134 to which journal bodies 136 are coupled via fasteners 138 to form cylinders 140 in which pistons 142 of piston assemblies 104 may reciprocate. A seal such as an O-ring or the like 144 may be disposed between each cylinder head boss 134 and journal body 136 for preventing leakage of the liquid from the cylinders 140 during operation of the pump 100. Head coupling bosses 146 formed in pump body 122 provide a surface for coupling the head assembly 106 to the pump housing 102 and include ports 148 for porting the liquid to and from the cylinders 140 and piston assemblies 104.

Each piston assembly 104 includes a strap coupling member 150 mounted to the outer end of piston 142 for coupling the piston 142 to straps 110. In the exemplary embodiment shown, straps 110 are clamped to the strap coupling members 150 by end clamp block 152 and fastener 154. This clamping arrangement allows loads to be more evenly distributed through the ends of straps 110.

In an exemplary embodiment, pistons 142 are formed of a ceramic material. However, it will be appreciated that pistons 142 may alternately be formed of other materials, for example metals such as aluminum, steel, brass, or the like without departing from the scope and spirit of the present invention. Cylinders 140 formed in journal bodies 136 may include a seal providing a surface against which the piston 142 may reciprocate and for preventing liquid within the cylinder 140 from seeping between the piston 142 and cylinder wall. Preferably, the seal is formed of a suitable seal material such as tetrafluoroethylene polymers or Teflon (Teflon is a registered trademark of E.I. du Pont de Nemours and Company), a butadiene derived synthetic rubber such as Buna N, or the like.

In the exemplary embodiment of the invention shown in FIGS. 2 and 3, eccentric assembly 108 includes shaft 130, bearing assemblies 112 & 114, and an eccentric 158. The eccentric 158 is comprised of a ring bearing assembly 160 and a bearing coupling member 162 for coupling the ring bearing assembly 160 to bearing assembly 112. Ring bearing assembly 160 is further coupled to straps 110 via clamp blocks 164 and fasteners 166 that clamp the center of straps 110 to the ring bearing assembly 160. This clamping arrangement allows loads within the center of strap 110 to be distributed more evenly. A counterweight 168 may be provided for balancing movement of the eccentric assembly 108 and piston assemblies 104 to reduce or eliminate vibration of the pump 100 during operation. Eccentric assembly 108 is secured together by fastener 170. Preferably, fastener 170 extends through bearing assembly 114, counterweight 168, ring bearing assembly 160, bearing coupling member 162, and bearing assembly 112 and is threaded into the center of shaft 130 to clamp these components together. As shown in FIG. 3, fastener 170 is off-centered in bearing coupling member 162 so that the ring bearing assembly 160 is positioned axially off-center with respect to the center of shaft 130 allowing the eccentric 156 to convert the rotary motion of the shaft 130 to rectilinear motion that is communicated to the piston assemblies 104 by straps 110 for reciprocating pistons 142. Collet 172 is engaged within bearing assembly 112 by fastener 170 for capturing and providing the proper pre-loading of bearing assemblies 112 & 114. The function of fastener 170 and collet 172 is described in co-pending U.S. Pat. application Ser. No. 09/639,435, filed Aug. 14, 2000, which is incorporated herein by reference in its entirety.

Referring again to FIGS. 2 and 3, head assembly 106 is secured to the head coupling bosses 146 of pump body 122 by fasteners 174. Seals such as a shaped O-ring, gasket, or the like 178 may be disposed between the head assembly 106 and head coupling bosses 146 for preventing leakage of the liquid during operation of the pump 100. Head assembly 106 ports the fluid through the pump 100 where its pressure and/or flow rate of the fluid is increased from a first pressure and/or flow rate to a second pressure and/or flow rate. As shown in FIG. 2, the head assembly 106 includes an inlet or low pressure portion 180 having a connector 182 such as a conventional garden hose connector, or the like for coupling the pump 100 to a source of fluid, for example, household tap water, at a first pressure and/or flow rate. The head assembly 106 also includes an outlet or high pressure portion 184 for supplying the liquid at a second pressure and/or flow rate.

In exemplary embodiments, the head assembly 106 may include a pressure unloader valve 186 for regulating pressure supplied by the pump and a thermal relief valve 188 to relieve excess pressure caused by thermal stresses. An injector assembly 190 may be provided for injecting a substance, for example, soap, into the fluid supplied by the outlet portion 184. A dampener hose 192 may be coupled to the outlet portion 184. The dampener hose 192 expands and lengthens to absorb pressure pulsations in the fluid induced by pumping. Alternately, other devices such as a spring piston assembly or the like may be employed instead of the dampener hose 192 to absorb pressure pulsations and substitution of such devices by those of ordinary skill in the art would not depart from the scope and spirit of the present invention.

Head assembly 106 may further include an integral start valve 194 for circulating the fluid within the head assembly 106 between the inlet portion 180 and the outlet portion 184 as the pump is started. The function of start valve 194 is described in co-pending U.S. Pat. application Ser. No. 09/639,435, filed Aug. 14, 2000, which is incorporated herein by reference in its entirety.

Figure 4A:
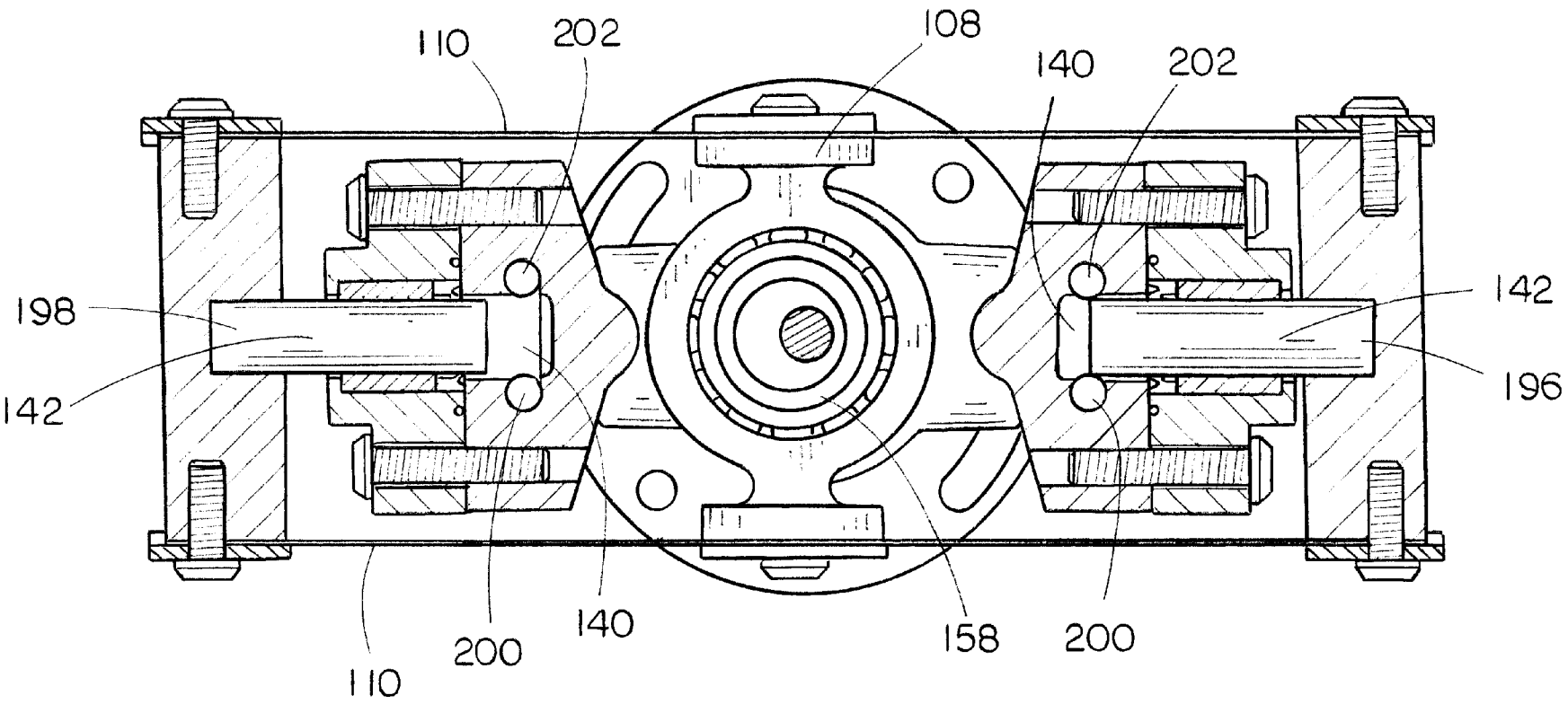
FIGS. 4A and 4B are cross sectional side elevational views illustrating operation of the flexible straps to drive the piston assemblies of the pump.
Figure 4B:
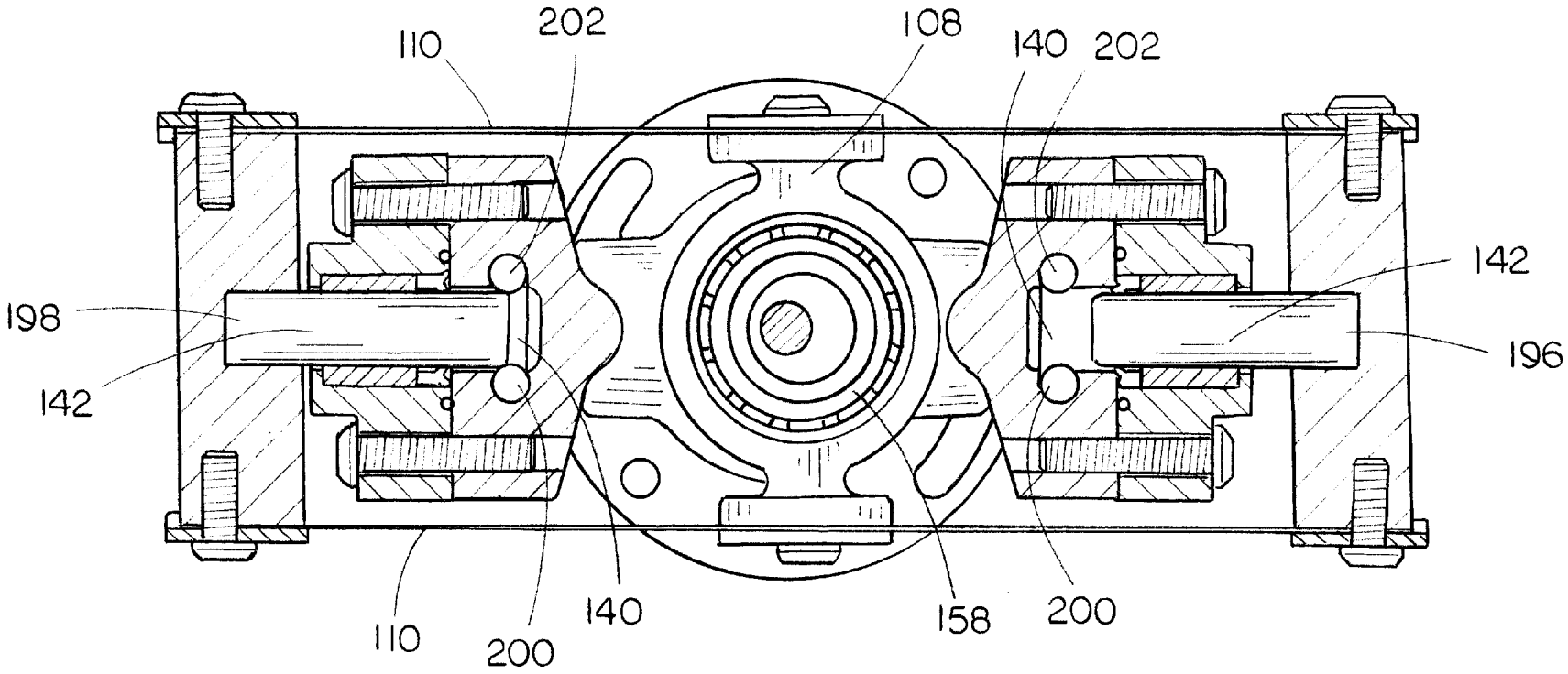

Referring now to FIGS. 4A and 4B, operation of the pump 100 is described. In the exemplary embodiment shown, the pump 100 includes axi-linearly opposed first and second piston assemblies 196 & 198. As shaft 130 (FIGS. 2 and 3) is turned by an engine, ring bearing assembly 160 of eccentric assembly 108 is moved from side to side converting the shaft's rotary motion to rectilinear motion. This rectilinear motion is communicated to the piston assemblies 104 by straps 110 for reciprocating pistons 142. Thus, as shown in FIG. 4A, as first piston assembly 196 undergoes a compression or pumping stroke for pumping the fluid thereby increasing its pressure and/or flow rate, second piston assembly 198 undergoes an intake stroke allowing fluid to be drawn into the piston assembly's cylinder 140. Consequently, the portions of straps 110 extending between the ring bearing assembly 160 and first piston assembly 196 are generally placed in compression, while the portions of straps 110 extending between the ring bearing assembly 160 and second piston assembly 198 are generally placed in tension.

Similarly, as shown in FIG. 4B, as second piston assembly 198 undergoes a compression or pumping stroke, first piston assembly 196 undergoes an intake stroke allowing fluid to be drawn into the piston assembly's cylinder 140. Thus, the portions of straps 110 extending between the ring bearing assembly 160 and second piston assembly 198 are generally placed in compression, while the portions of straps 110 extending between the ring bearing assembly 160 and first piston assembly 196 are generally placed in tension. Pump body 122 includes porting 148 providing inlet and outlet ports to cylinders 140 for porting the fluid into and out of the cylinders 140. Preferably, inlet ports 202 include valves (not shown) that shut during the compression strokes of their respective piston assemblies 196 & 198 to prevent back flow of the fluid into the inlet portion 180 of head assembly 106.

Preferably, the shape and thickness of flexible straps 110 are optimized to withstand the alternating bending and tension loads placed on them during operation of the pump 100 For example, in the exemplary embodiment shown in FIGS. 1 through 4B, each strap is comprised of a thin strip of steel having a generally double hourglass shape that widens adjacent to points of attachment of the strap 110 to the strap coupling members 150 and ring bearing assembly 160. This shape allows the strap 110 to flex and bend as piston assemblies 104 are reciprocated, and to distribute loads throughout the strap 110 more evenly.

Figure 5A:
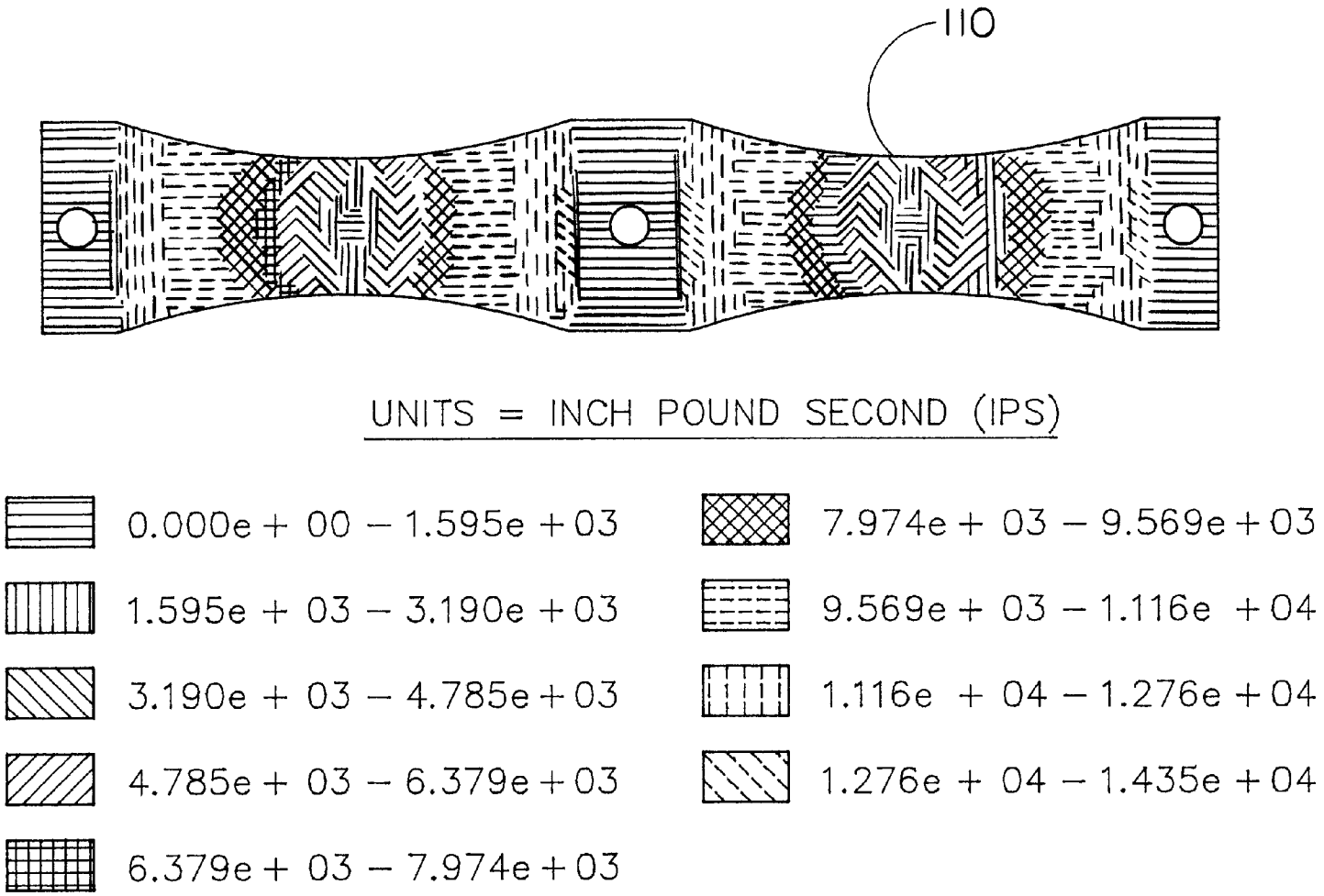
FIGS. 5A and 5B are graphical representations of the results of a finite element analysis of an exemplary flexible strap of the pump in accordance with the present invention.
Figure 5B:
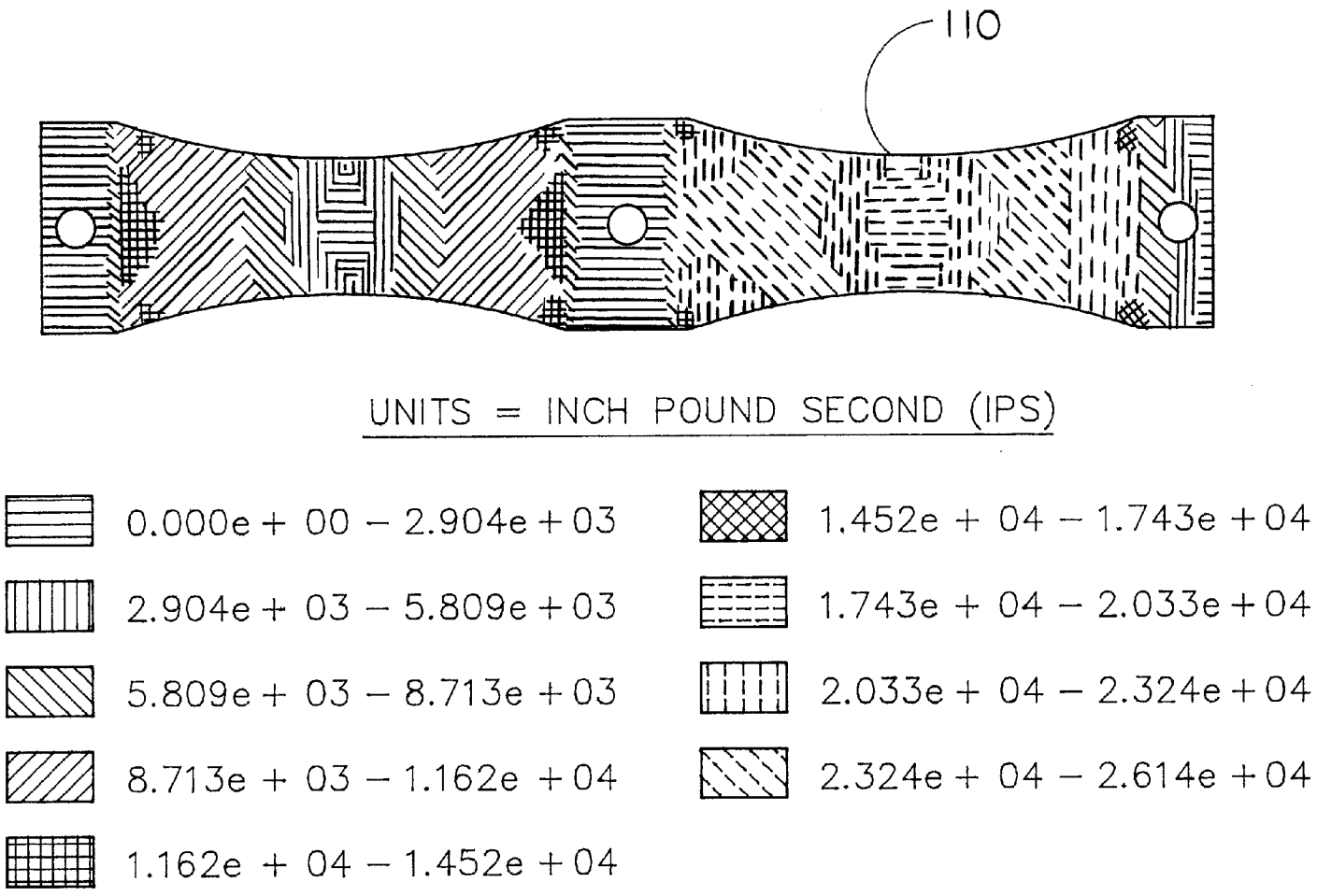

In exemplary embodiments, the shape of straps 110 may be determined utilizing finite element analysis. By way of example, the distribution of maximum Von Mises stress, as determined by finite element analysis, for the straps 110 of an exemplary pump rated at 2200 PSI and having a flow rate of 2.1 GPM are shown in FIGS. 5A and 5B. FIG. 5A illustrates the distribution of maximum Von Mises stress for the straps 110 when subjected to bending loads. As shown, the average maximum stress was determined to be $1.4354e^{+04}$ IPS (inch pound second) with a maximum displacement of $+1.4200e^{-01}$ inches. Similarly, FIG. 5B illustrates the distribution of maximum Von Mises stress for the straps 110 when subjected to tensile loads. As shown, the average maximum stress was determined to be $2.6140e^{-01}$ IPS with a maximum displacement of $+1.4202e^{-01}$ inches.

It is believed that the oilless high pressure pump of the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A pump for pumping a liquid, comprising a pump housing having at least one cylinder;

a piston assembly disposed in said cylinder of said housing, said piston assembly including a piston capable of reciprocating within said cylinder;

an eccentric assembly suitable for converting rotary motion of a rotating shaft to rectilinear motion; and a strap for coupling said eccentric assembly and said piston assembly;

wherein said strap is suitable for communicating the rectilinear motion of said eccentric assembly to said piston assembly for reciprocating said piston in said cylinder to pump said liquid.

2. The pump as claimed in claim 1, wherein said eccentric assembly comprises:

a shaft suitable for being coupled to the drive shaft of an engine;

at least one bearing assembly for supporting said shaft in said pump housing so that said shaft may rotate; and an eccentric for converting the rotary motion of said shaft to rectilinear motion.

3. The pump as claimed in claim 2, wherein said at least one bearing assembly comprises a sealed bearing.

4. The pump as claimed in claim 2, wherein said eccentric assembly further comprises a counterweight assembly coupled to said shaft for counterbalancing said piston assembly.

5. The pump as claimed in claim 1, wherein said strap is flexible.

6. The pump as claimed in claim 1, wherein said piston assembly further comprises a strap coupling assembly for coupling said piston to said strap.

7. The pump as claimed in claim 1, wherein said piston is ceramic.

8. The pump as claimed in claim 1, further comprising a head assembly for porting said liquid through said pump housing.

9. A pump for pumping a liquid, comprising a pump housing having linearly opposed cylinders;

a piston assembly disposed in each of said cylinders, each of said piston assemblies including a piston;

an eccentric assembly suitable for converting rotary motion of a rotating shaft to rectilinear motion; and at least two flexible straps for coupling said eccentric assembly and each of said piston assemblies;

wherein said straps are suitable for communicating the rectilinear motion of said eccentric assembly to said piston assemblies for reciprocating said pistons in said cylinders to pump said liquid.

10. The pump as claimed in claim 9, wherein said eccentric assembly comprises:

a shaft suitable for being coupled to the drive shaft of an engine;

at least one bearing assembly for supporting said shaft in said pump housing so that said shaft may rotate; and an eccentric for converting the rotary motion of said shaft to rectilinear motion.

11. The pump as claimed in claim 10, wherein said at least one bearing assembly comprises a sealed bearing.

12. The pump as claimed in claim 10, wherein said eccentric assembly further comprises a counterweight assembly coupled to said shaft for counterbalancing movement of said piston assemblies.

13. The pump as claimed in claim 9, wherein said straps are flexible.

14. The pump as claimed in claim 9, wherein each piston assembly further comprises a a strap coupling assembly for coupling said piston to said straps.

15. The pump as claimed in claim 9, wherein said pistons are ceramic.

16. The pump as claimed in claim 9, further comprising a head assembly for porting said liquid through said pump.

17. A power washer, comprising a frame;

an engine mounted to said frame;

a pump coupled to said engine, said pump further comprising:

a piston assembly including a piston;

an eccentric assembly suitable for converting rotary motion of a rotating shaft to rectilinear motion; and a strap for coupling said eccentric assembly and said piston assembly;

wherein said strap is suitable for communicating the rectilinear motion of said eccentric assembly to said piston assembly for reciprocating said piston in said cylinder to pump said liquid.

18. The power washer as claimed in claim 17, wherein said eccentric assembly comprises:

a shaft suitable for being coupled to the drive shaft of an engine;

at least one bearing assembly for supporting said shaft in said pump housing so that said shaft may rotate; and an eccentric for converting the rotary motion of said shaft to rectilinear motion.

19. The power washer as claimed in claim 18, wherein said at least one bearing assembly comprises a sealed bearing.

20. The power washer as claimed in claim 18, wherein said eccentric assembly further comprises a counterweight assembly coupled to said shaft for counterbalancing movement of said piston assemblies.

21. The power washer as claimed in claim 17, wherein said straps are flexible.

22. The power washer as claimed in claim 17, wherein each piston assembly further comprises a strap coupling member and clamping block for coupling said piston assembly to said straps.

23. The power washer as claimed in claim 17, wherein said pistons are ceramic.

24. The power washer as claimed in claim 17, further comprising a head assembly for porting said liquid through said pump.

* * * * *